United States Patent [19]

Nagaishi et al.

[11] Patent Number: 4,873,641

[45] Date of Patent: Oct. 10, 1989

[54] INDUCTION VOLUME SENSING ARRANGEMENT FOR AN INTERNAL COMBUSTION ENGINE OR THE LIKE

[75] Inventors: Hatsuo Nagaishi, Zushi; Yasuo Seimiya, Fujisawa; Hideyuki Tamura, Yokohama; Hiromichi Miwa, Yokohama; Hiroshi Sanbuichi, Yokohama; Masaaki Uchida, Yokohama; Toshio Takahata, Yokohama, all of Japan

[73] Assignee: Nissan Motor Company, Limited, Yokohama, Japan

[21] Appl. No.: 68,942

[22] Filed: Jul. 1, 1987

[30] Foreign Application Priority Data

Jul. 3, 1986 [JP] Japan ..... 61-156837
Jul. 25, 1986 [JP] Japan ..... 61-174997
Jul. 29, 1986 [JP] Japan ..... 61-177949

[51] Int. Cl.[4] ..... F02M 17/00

[52] U.S. Cl. ..... 364/431.04; 364/431.03; 123/492; 123/494; 73/118.2

[58] Field of Search ..... 364/431.03, 431.05, 364/431.07, 431.08, 431.04, 431.12; 123/306, 486, 489, 492, 494; 73/117.3, 118.2, 119 A

[56] References Cited

U.S. PATENT DOCUMENTS 4,275,694 6/1981 Nagaishi ..... 123/463
4,332,226 6/1982 Nomura et al. ..... 123/494
4,530,333 7/1985 Nishimura ..... 123/489
4,549,516 10/1985 Koumura ..... 123/478
4,594,987 6/1986 Wataya et al. ..... 123/494
4,651,693 3/1987 Nakajima et al. ..... 123/306
4,737,914 4/1988 Abe et al. ..... 123/489

FOREIGN PATENT DOCUMENTS 0142856 11/1984 European Pat. Off. .
2847794 5/1979 Fed. Rep. of Germany .
3438429 10/1984 Fed. Rep. of Germany .

OTHER PUBLICATIONS

MTZ, "Mono-Jetronic—A Precise Fuel-Injection System . . . Self-Adaption", vol. 47, May 1986, pp. 179.

*Primary Examiner*—Eugene R. LaRoche
*Assistant Examiner*—Seung Ham
*Attorney, Agent, or Firm*—Foley & Lardner, Schwartz, Jeffery, Schwaab, Mack, Blumenthal & Evans

[57] ABSTRACT

The throttle valve position of an engine is sensed and the effective cross sectional area of the induction passage is determined via table look-up. The table is recorded in terms of three parameters. The value thus derived is divided by the engine speed of alternatively a product of the engine speed and the engine displacement. A basic air induction quantity is then determined via table look-up and is subsequently modified using a correction coefficient to allow for the effect of engine speed on the same. The effect of injector position (viz., multi-point injection/single point injection) and/or the provision of a swirl control valve can be additionally taken into consideration via the use of suitable algorithms or additional two and three parameter system tables. If an idle control by-pass passage is provided, the effect of the opening degree is considered when determining the effective cross-section of the induction passage.

27 Claims, 16 Drawing Sheets

130
I/O
CPU
ROM
RAM
100
104
106
108
110
112
114
116
118
120
122
124
126
134
102
II
II

INDUCTION VOLUME SENSING ARRANGEMENT FOR AN INTERNAL COMBUSTION ENGINE OR THE LIKE

BACKGROUND OF THE INVENTION

1. Field of the Invention

The present invention relates generally to an internal combustion engine and more specifically to an induction sensor arrangement for a fuel injected engine or the like which enables accurate derivation of the amount of air inducted thereinto without the need for excessively large amounts of pre-memorized data.

2. Description of the Prior Art

In order to optimally control fuel injected engines it is vital to accurately sense the amount of air being inducted into the engine. To achieve this there are two basic types of air induction sensor arrangements: (a) those which sense the amount of air being inducted directly and (b) those which derive the same indirectly using two or more related parameters.

Hotwire/vortex and flap type air flow sensors fall into the first category. However, these sensors tend to be overly responsive to the pressure pulsations which occur in the induction system and thus suffer from the drawback that their accuracy is apt to vary widely depending on the mode of the operation of the engine. This induces the drawback that, as the amount of fuel supplied to the engine is determined using the sensed induction volume, the torque generated by the engine tends to undesirably fluctuate with the accuracy of the induction system.

In the case of indirect sensing, it is known to combine the engine rotational speed, the output of a pressure sensor which detects the pressure in the induction manifold and the output of a throttle valve position sensor.

However, in order to cover all of the possible parameter combinations and thus enable a good matching of the amount of fuel injected with the instant mode of operation over the whole range of engine operation, it is necessary to record a vast amount of data in the form of a four parameter system (or systems) wherein each value of one parameter has three corresponding values which define its position in a three-dimensional lattice, namely, record tables which can be depicted in the form of (three dimensional) contour maps. This requires a large amount of memory space (ROM) and increases the cost of the system. One solution to this problem is to reduce the amount of data which is recorded by increasing the increments between each of the recorded values (viz., reduce the resolution of the mapping). However, this tends to cause the control of the system to become overly coarse and deteriorates the accuracy of the same.

The above mentioned memory problem is further aggrevated when the engine is provided with a swirl control arrangement. Viz., as the swirl control valve effects the effective cross sectional area of the induction conduit the accuracy of the derivation possible using only the above mentioned parameters is severely jeopardized. Accordingly, in order to take this effect into consideration an additional large amount of data is required.

SUMMARY OF THE INVENTION

An object of the present invention is to enable the amount of air being inducted into the engine to be accurately estimated (viz., be indirectly sensed) without the need of pre-recording very large amounts of data in the form of four parameter system look-up tables and the need for a corresponding large amount of ROM or the like memory space.

In brief, in order to achieve this object the throttle valve position is sensed and this position value is used to determine the effective cross sectional area of the induction passage via table look-up. The data is stored in a table or map which is recorded in the form of a three parameter system. The value derived by this technique is then divided by the engine speed or alternatively a product of the engine speed and the engine displacement. A basic air induction quantity is then determined via table look-up. This value is subsequently modified using a correction coefficient to allow for the effect of engine speed. The effect of injector position (viz., MPI/SPI) and/or the provision of a swirl control valve can be additionally taken into consideration via the use of suitable algorithms or additional tables recorded in terms of two or three parameters. If an idle control by-pass passage is provided the opening of the valve which controls the same can be taken into consideration when determining the effective cross-section of the induction passage.

More specifically, a first aspect of the present invention takes the form of a method of operating an internal combustion engine which is characterized by the steps of: sensing a first engine operational parameter which indicates the load on the engine; sensing a second engine operational parameter which indicates the rotational speed of the engine; recording a first set of data which defines a first table which can be visualized as a first two dimensional map; deriving a first variable by comparing the value of the first engine operational parameter with the first set of recorded data; modifying the first variable using the value of the second engine operational parameter to derive a second variable; recording a second set of data which defines a second table which can be visualized as a second two dimensional map; and comparing the value of the second variable with the second set of recorded data to obtain a third variable indicative of the amount of air being inducted into the engine and which can be used to implement engine air-fuel control.

A second aspect of the present invention comes in the form of an internal combustion engine which is characterized by: a first sensor for sensing a first engine operational parameter which indicates the load on the engine; a second sensor for sensing a second engine operational parameter which indicates the rotational speed of the engine; and means for: deriving a first variable by comparing the value of the first engine operational parameter with a first set of recorded data, the data being recorded in the form of a first table which can be visualized as a first two dimensional map; modifying the first variable using the value of the second engine operational parameter to derive a second variable; and comparing the value of the second variable with a second set of recorded data to obtain a third variable which can be used to implement engine control, the second set of data being recorded in the form of a second table which can be visualized as a second two dimensional map.

DETAILED DESCRIPTION OF THE PREFERRED EMBODIMENTS

Figures 1, 2:
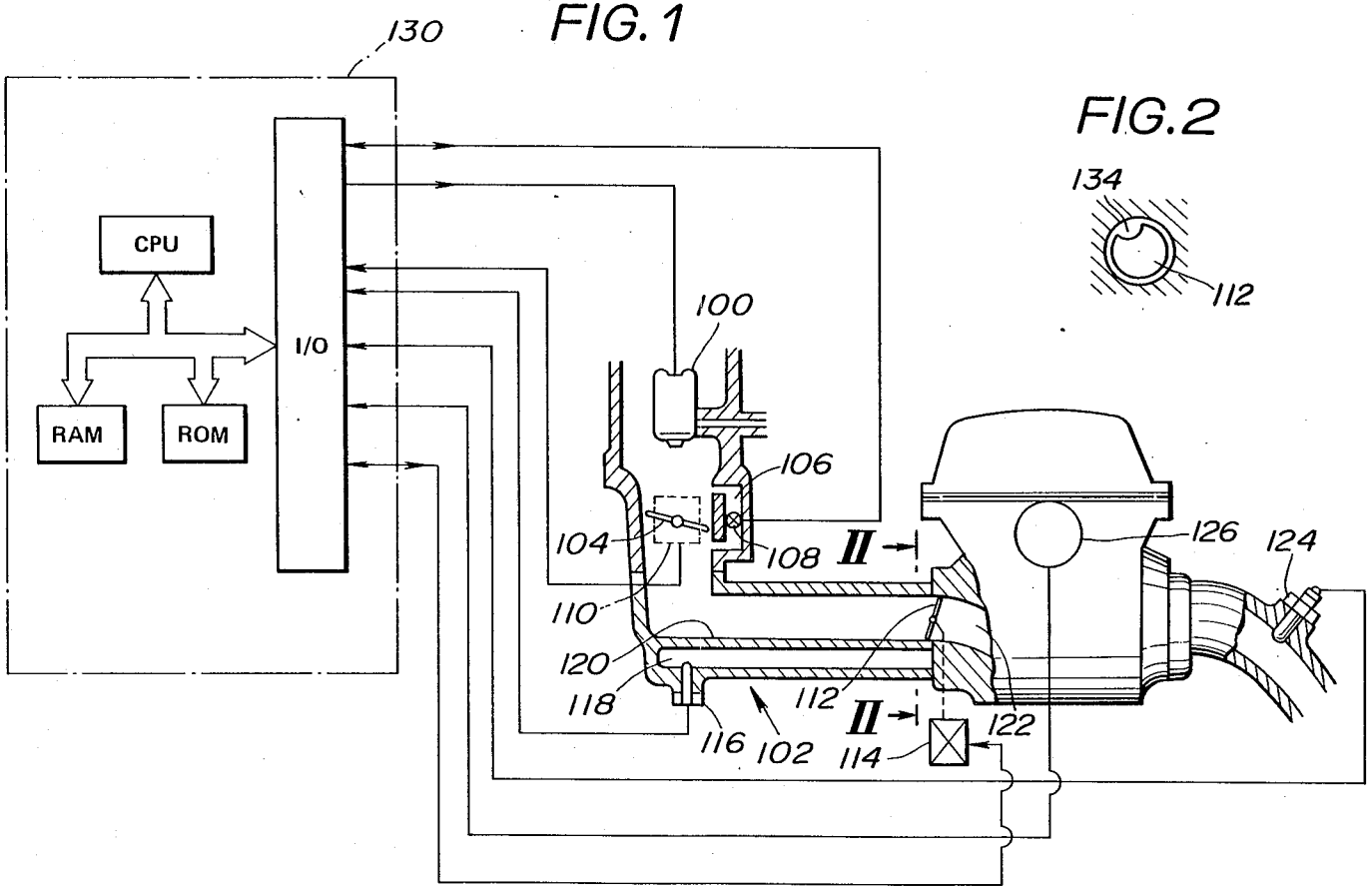
FIG. 1 shows an engine system to which the embodiments of the present invention are applied.
FIG. 2 is a section taken along section line II—II of FIG. 1 showing the shape of a swirl control valve disposed in the downstream section of the induction system.

FIG. 1 shows in partial cross-section an internal combustion engine to which the embodiments of the present invention are applied. In this arrangement a single point injection valve 100 is disposed in the upstream section of an induction manifold 102 at a location upstream of a throttle valve 104, a by-pass passage 106 which leads around the throttle valve 104, and an idle control valve 108 disposed in the by-pass passage 106. A position sensor 110 is operatively connected with the throttle valve 104 for sensing the opening degree of the same. Disposed at the downstream end of the manifold is a swirl control valve, or similar, device 112. This device is operatively connected with a control servo 114.

The illustrated arrangement further includes a temperature sensor 116 arranged to sense the temperature of the engine coolant which is circulated through a heating jacket arrangement 118 disposed along the lower surface of the runners 120 which lead from a riser of the manifold 102 to each of the induction ports 122 of the engine.

An air-fuel ratio sensor 124 (e.g. $O_2$ sensor or the like device) is disposed in the exhaust system for sensing the content of the exhaust discharged from the combustion chambers of the engine.

Operatively connected with the crankshaft of the engine or ignition system is an engine rotational speed sensor 126.

A control unit 130, which in this embodiment includes a microprocessor, is arranged to receive inputs from the above mentioned sensors via an I/O interface. The ROM of the microprocessor contains various programs and pre-determined data. These programs are, as will be made clear hereinlater, arranged to process the information provided by the sensors and selectively induce the output of various command signals to a fuel injector, a servo 132 (see FIG. 3) which operates the idle control valve 108 and to the servo 114 of the swirl control arrangement. The just mentioned servos are arranged to generate feedback signals which are inputted to the control unit via the I/O interface.

An example of a swirl generating vane used in combination with the servo 114 is shown in FIG. 2. The vane includes a cut-out section 134 for creating a relatively high velocity flow which enters the combustion chamber of each engine cylinder in a manner which induces a swirling flow pattern therein. For further disclosure relating to swirl generating arrangements reference may made to U.S. Pat. No. 4,651,693 issued on Mar. 24, 1987 in the name of Nakajima et al, and copending U.S. patent application Ser. No. 917,589, now U.S. Pat. No. 4,726,341 filed on Oct. 10, 1986 in the name of Muranaka et al. The content of these documents is hereby incorporated by reference thereto.

Figure 3:
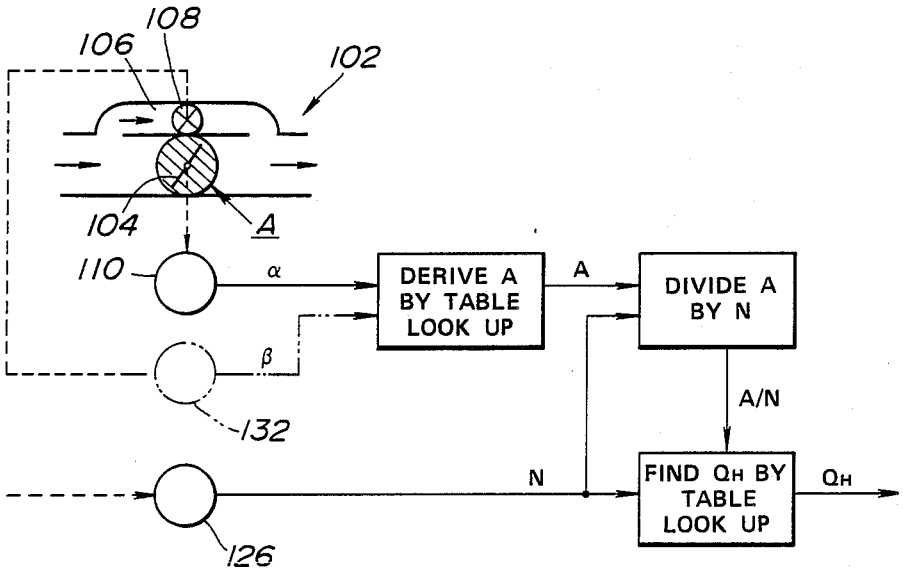
FIG. 3 shows in schematic form a concept which underlies the first embodiment of the present invention.

The characteristic arrangement of the first embodiment of the present invention is shown in FIG. 3. This embodiment involves the indirect derivation of the amount of air being inducted in the engine using only the throttle valve position and engine speed parameters.

In brief, a value alpha representative of the throttle valve opening is used to derive a value A representative of the effective cross-section of the induction passage. This value is then divided by the engine speed N to derive a value A/N. This A/N value is subsequently used in combination with the engine speed N to derive a value QH, indicative of the (basic) amount of air being inducted, via table look-up.

In the event that the induction system is provided with a by-pass passage, i.e., #106, which leads around the throttle valve 104 for the purposes of idle control, the opening degree of the valve 108 which controls the same is sensed and a signal Beta indicative of the opening degree generated. This value is used in combination with the value of alpha for deriving the value of A.

Figure 4:
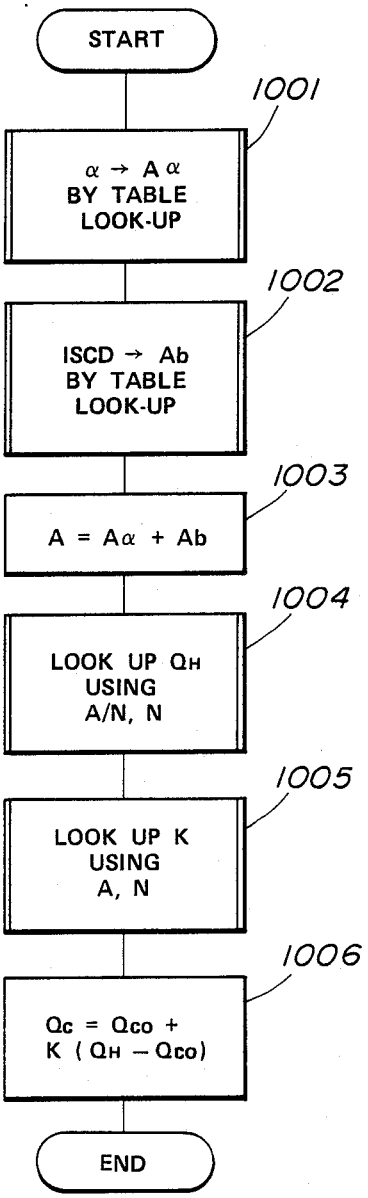
FIG. 4 is a flow chart showing the steps which characterize the derivation of the induction air quantity according to the first embodiment.

FIG. 4 shows in flow chart form the steps which characterize a program used in the first embodiment to execute the above mentioned calculations.

Figure 5:
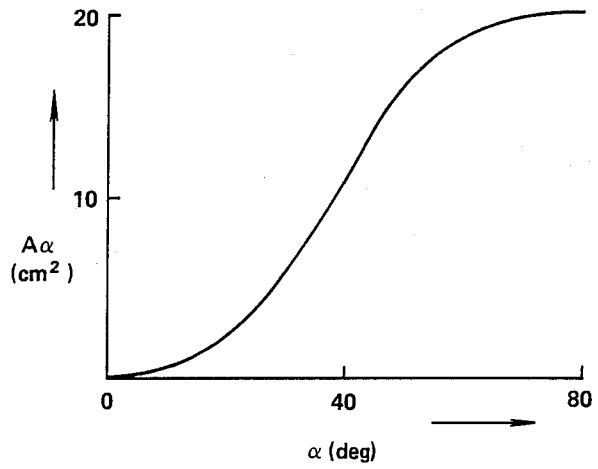
FIG. 5 is a graphical illustration of a first table which is recorded in memory in terms of the throttle valve opening and the effective cross section of the induction passage for the given throttle opening.

As shown, the first step 1001 of this program is to sample the input from the throttle position sensor 110 and to derive a signal A-alpha indicative of the effective cross-section of the induction passage with the throttle valve 104 in its instant position. In this embodiment this derivation is performed by table look-up using a table of the nature depicted in FIG. 5. This table is recorded in terms of two parameters only and therefore consumes relatively little memory space.

Figure 6:
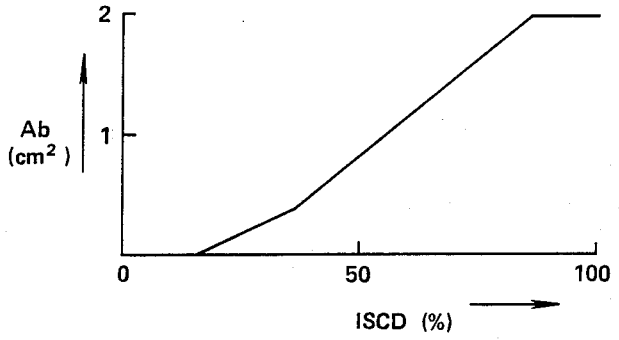
FIG. 6 is a graphical illustration of a second table which is recorded in memory in terms of idle the valve opening (%) and the corresponding effective cross-section of a by-pass passage which leads around the main or primary throttle valve.

In step 1002 an ISCD feedback signal Beta from the idle control valve servo is sampled and a value Ab is derived using a table look-up technique. In this embodiment a table of the nature shown in FIG. 6 is used for this purpose.

At step 1003 the values A-alpha and Ab are summed to determine the total cross-section available for air to flow toward the cylinders of the engine.

Following the derivation of A the value of A/N where N represents the instant engine speed as determined by sampling the output of the engine speed sensor, is obtained. This value and the corresponding value of N are used to perform a table look-up using a table of the nature illustrated in FIG. 7. This table is recorded in terms of three parameters namely, N, A/N and QH wherein QH is the basic air induction quantity.

Figure 8:
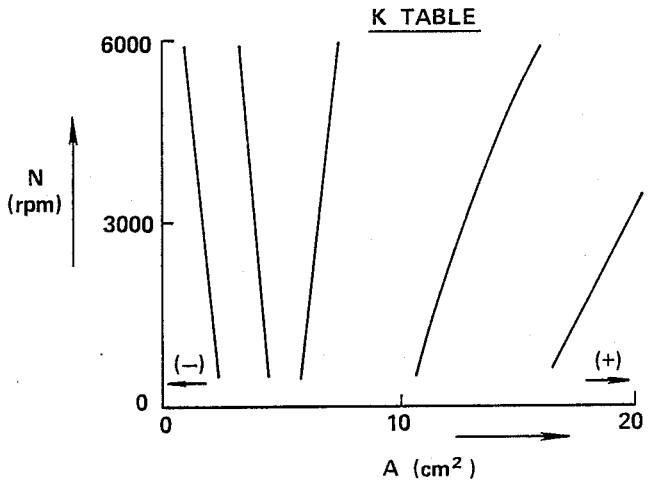
FIG. 8 graphically shows a fourth table recorded in terms of engine speed, effective cross sectional area and a correction factor K which is used to modify the value of QH derived using the table shown in FIG. 7.

At step 1005 a table look-up technique using the values of A and N is performed in order to derive the value of a correction coefficient K which compensates for the engine speed related variation in volume of air inducted into the engine cylinders. The table used in this operation is of the nature shown in FIG. 8. As will be appreciated from this figure, the cylinder charging characteristics over an engine speed range of 0 to 6000 RPM vary quite notably depending on the degree to which the throttle valve is opened. For example, until the throttle valve 104 is opened beyond a given amount the amount of air introduced into the cylinders per cycle actually reduces with an increase in engine speed.

At step 1006 the value of the coefficient K derived in the previous step is used to obtain a corrected air induction value (Qc) using the following equation:

$$Qc = QCo + K(QH - QCo) \quad (1)$$

wherein:

QCo is the value of QH derived on the previous run of the instant program (under steady state engine operation QCo=QH).

However, while the value of Qc is suitable for use with multi-point fuel injection arrangements (MPI) wherein each of the injectors is arranged in/or immediately upstream of the engine intake ports, it is necessary to take into consideration the fact that with single point injection (SPI) systems the injector is located some distance upstream of the respective inlet valves. In this instance correction is required to enable the accurate control of the air-fuel ratio of the air-fuel mixture which actually enters the cylinders.

In the instant embodiment, programs are provided which take these factors into account, make the appropriate corrections and produce values for both arrangements.

Figure 9:
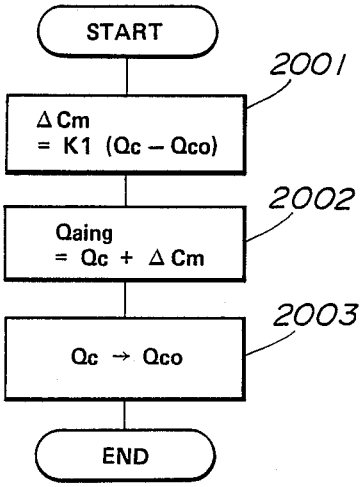
FIG. 9 is a flow chart depicting the steps excuted during the calculation of an induction air amount which is modified for use in SPI injection systems.
Figure 10:
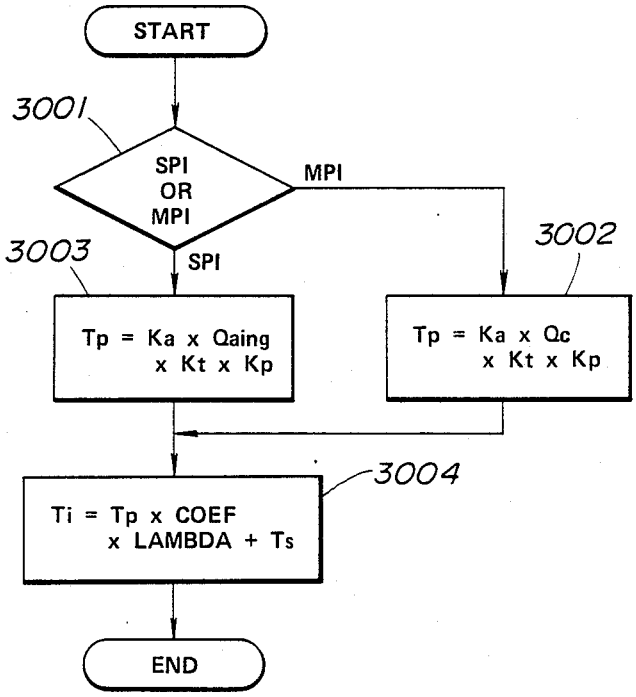
FIG. 10 shows a flow chart depicting the characterizing steps of a program which calculates the amount of fuel to be injected using the air induction value derived in the programs illustrated in FIGS. 4 and 9.

The steps which characterize the just mentioned programs are shown in FIGS. 9 and 10.

In step 2001 of the flow chart shown in FIG. 9 a value DeltaCm is calculated using the following equation:

$$DeltaCm = K1(Qc - QCo) \quad (2)$$

wherein:

DeltaCm is a value representative of the amount of air which must be added to the basic quantity in order to compensate for the distance between the SPI injector and the cylinders;

K1 is a constant which is determined for each type of induction manifold/system and QCo and Qc are the values utilized in step 1006 of the flow chart shown in FIG. 4.

In step 2002 the calculation of a value Qaing is carried out and in step 2003 the instant value of Qc is set in RAM as QCo in preparation of the next run of program described in connection with steps 1001 to 1006 of FIG. 4, and the instant run of this program finishes.

In step 3001 of the flow chart shown in FIG. 10 it is determined whether the induction system to which the present invention is applied is provided with a single point injection (SPI) arrangement or a plurality of multi-point injectors (MPI).

In the event that the system is equipped with MPI then the program flows to step 3002 wherein the following equation is executed:

$$Tp = Ka \times Qc \times Kt \times Kp \quad (3)$$

wherein:

Tp denotes the basic fuel injection quantity;

Ka is a constant;

Kt is an air temperature correction coefficient; and

Kp is an air pressure correction coefficient.

On the other hand, if the system is similar to that illustrated in FIG. 1 and provided with a single injector (SPI) upstream of the throttle chamber then the program flows to step 3003 wherein equation (4) is executed:

$$Tp = Ka \times Qaing \times Kt \times Kp \quad (4)$$

It will be noted that the values other than Qc are as set forth above.

At step 3004 the actual amount of fuel (Ti) to be injected in the instant cycle of the engine is determined using the equation:

$$Ti = Tp \times COEFF \times LAMBDA + Ts \quad (5)$$

wherein:

COEFF denotes a correction factor which compensates for a plurality of coefficients which effect the time required for the fuel to reach the combustion chamber. This factor includes the effects caused by wetting of the induction passage walls, the influence of the engine temperature, the rate of evaporation of the fuel, engine start up, idling, etc.,;

LAMBDA is a feed-back correction coefficient which is variable with the output of the air-fuel ratio sensor disposed in the exhaust system of the engine; and Ts is a correction factor which allows for the rise time of the fuel injector and which is added to a pulse width (Ti) in order to compensate for the reduction in actual injection which would otherwise occur.

Figure 11:
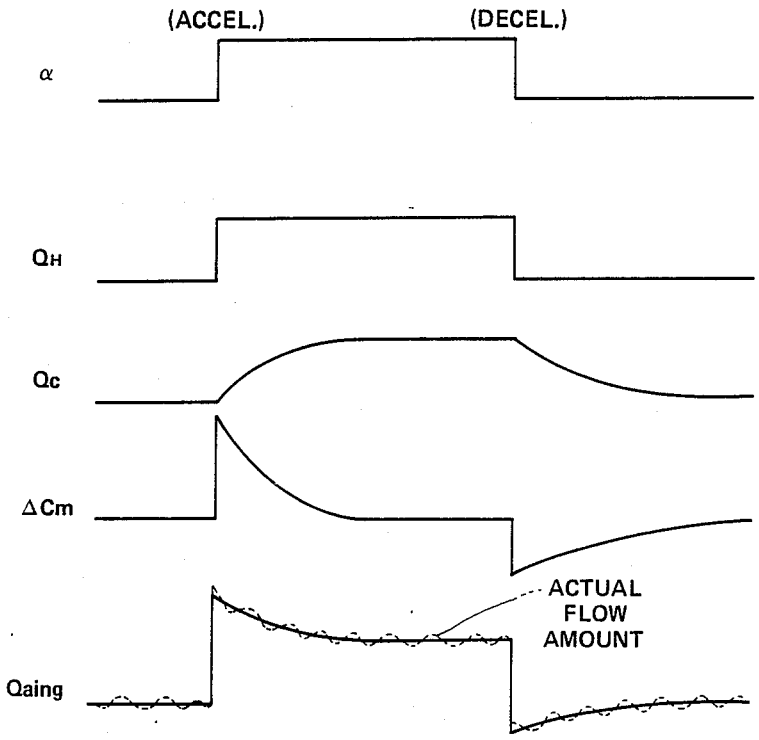
FIG. 11 is a timing chart illustrating the correlation between the change in throttle valve position and the variation in the values of the air induction amounts calculated for multi-point fuel injection systems (QC) and SPI type arrangements (Qaing)

With the above described control due to the derivation of Qc it is possible to suitably control the fuel injection in a manner such that good air-fuel ratio control is effected during both acceleration and deceleration (transient) modes of operation as well as during steady state operation. That is to say, as will be apparent from the timing charts shown in FIG. 11, with the above technique it is possible to avoid supplying both excessive amounts or insufficient quantities of fuel over the whole range of engine operation.

It will be noted that although the above method does not take the ignition timing of the engine into consideration such control is within the scope of the present invention.

Figure 12:
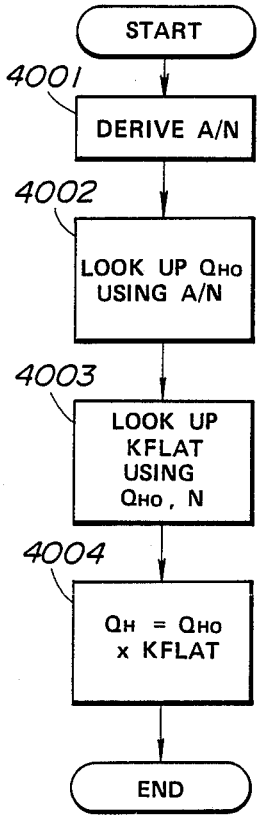
FIG. 12 is a flow chart showing the steps which characterize the derivation of the air induction amount according to a second embodiment of the present invention.

FIG. 12 shows in flow chart form the steps which characterize the operation of a second embodiment of the present invention. As shown, in the first step of this program (4001) a value A/N is derived in essentially the same manner as described in connection with steps 1001 to 1004 of the flow chart shown in FIG. 4. In step 4002 a table look-up is performed to determine a value of QHO. This operation involves the use of a table wherein a linearized value of QHO is plotted against A/N (see FIG. 13 by way of example). Then, using a table recorded in terms of N (engine speed) and QHO FIG. 14 is used to determine a correction coefficient KFLAT. Subsequently, a value QH is derived by modifying QHO with the correction coefficient using the following equation:

$$QH = QHO \times KFLAT \quad (6)$$

Figure 7:
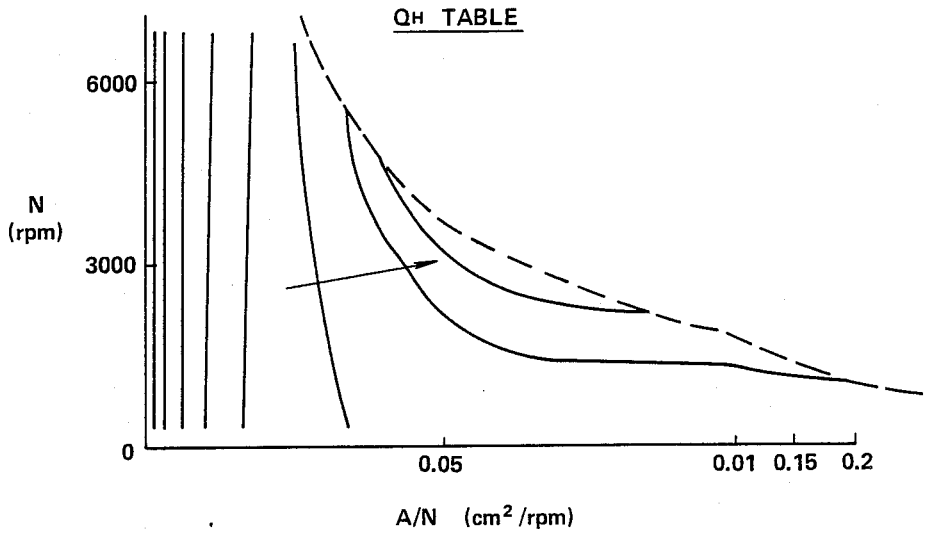
FIG. 7 is a graphical representation of a third table which is recorded in memory in terms of engine speed, the ratio of the effective cross sectional area of the induction passage to the engine speed, and a value QH indicative of the amount of air being inducted.
Figure 13:
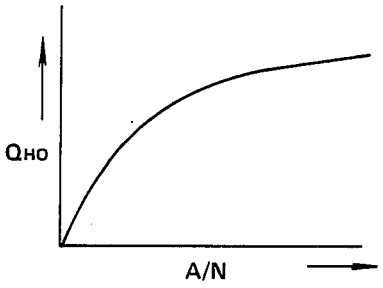
FIGS. 13 and 14 are graphical representations of tables which are recorded in memory for use with the second embodiment.
Figure 14:
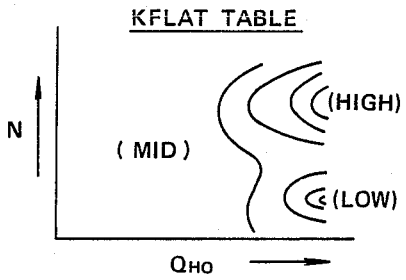

It will noted that although the memory space required for the QHO data amounts to about 2 bytes, the table depicted in FIG. 14 is recorded in terms of three parameters while the table of FIG. 13 is compiled using only two (viz., A/N and QHO). This permits a reduction of the total memory space required as compared with the first embodiment wherein the tables depicted in FIGS. 6 and 7 are both recorded in terms of three parameters.

Figure 15:
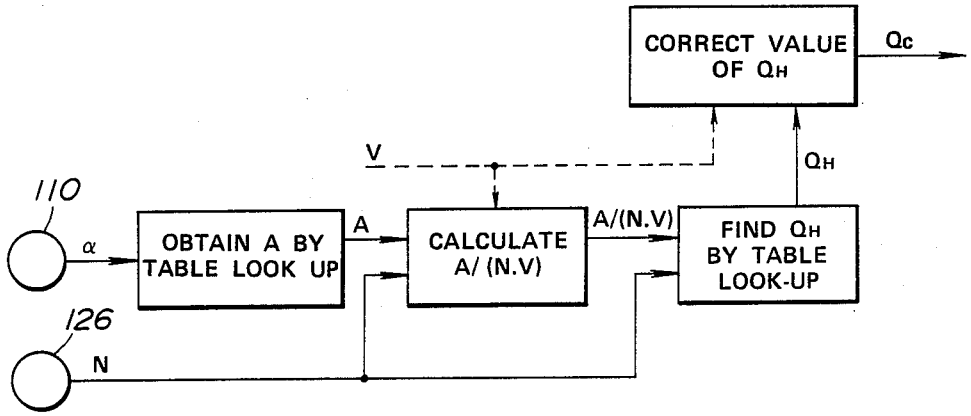
FIG. 15 shows in schematic form the arrangement which characterizes a third embodiment of the present invention.
Figure 16:
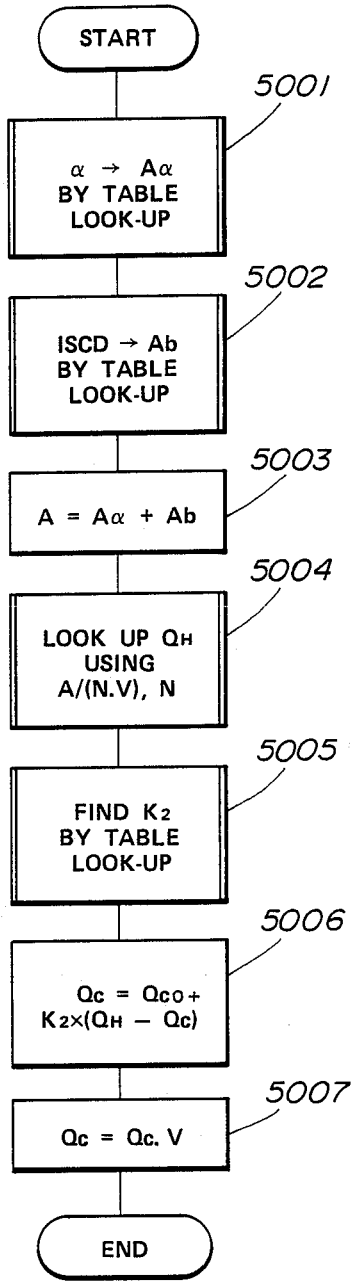
FIG. 16 is a flow chart showing the steps which characterize the operation of the third embodiment.
Figure 17:
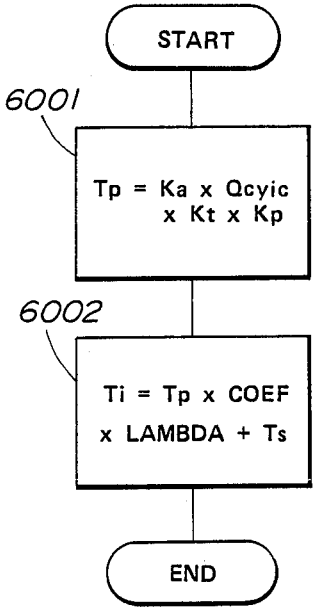
FIG. 17 is a flow chart showing the steps which characterize the calculation of the amount of fuel which should be injected under the instant set of operating conditions.
Figure 18:
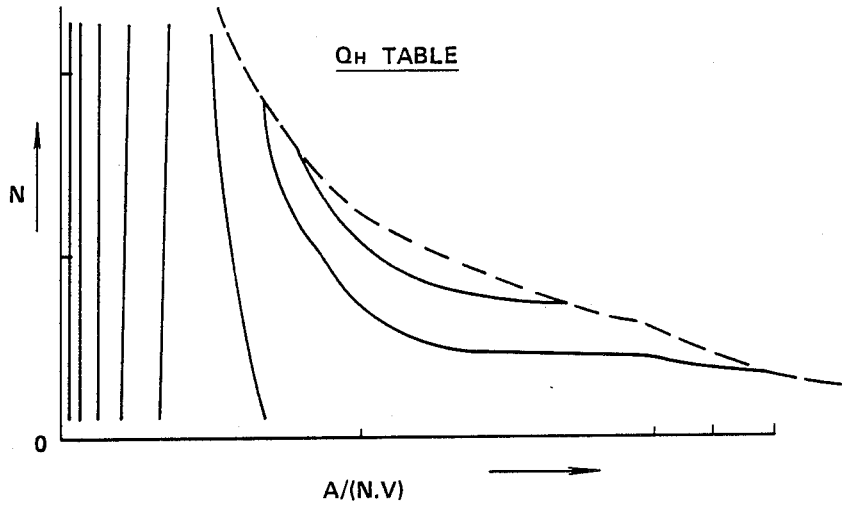
FIGS. 18 and 19 are graphical representations of tables which are recorded in memory and which are used in conjunction with the third embodiment.
Figure 19:
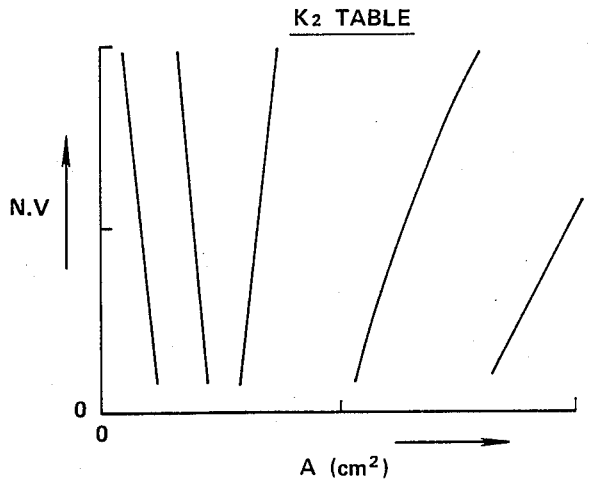

FIG. 15 shows in schematic form the arrangement which characterizes a third embodiment of the present invention. This embodiment is basically similar to the first one but features a derviation which involves the use of a value V representative of the engine displacement. As shown, the value of alpha is used in the same manner as in the first embodiment to determine the effective cross section A of the induction system via table look-up. However, this value is then divided by both the engine speed and the displacement and is subsequently used to find an air induction value QH by table look-up. This QH value is then modified using a correction factor K2 which is obtained by table look-up in order to derive a value which is corrected for the instant set of operating conditions.

As will be apparent from FIGS. 16 to 20 the mode in which this embodiment derives the required induction air quantity value is essentially similar to that disclosed in connection with FIGS. 4 to 10. Accordingly, a detailed explanation thereof will not be repeated for brevity. It will be noted that this embodiment makes use of tables which are essentially identical to those shown in FIGS. 5 and 6 and which are not shown in order to obviate redundant drawing repetition.

Figure 20:
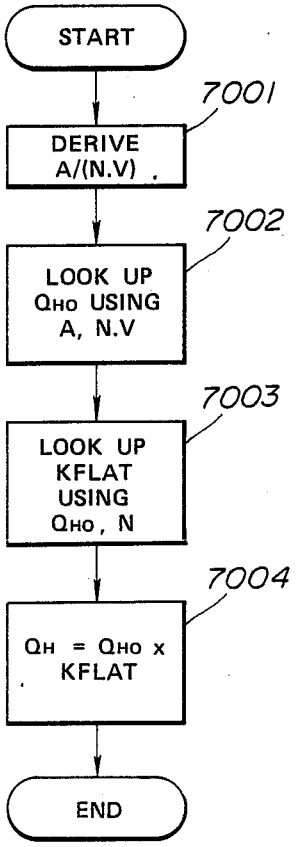
FIG. 20 is a flow chart showing the steps which characterize the operation of a fourth embodiment of the present invention.
Figure 21:
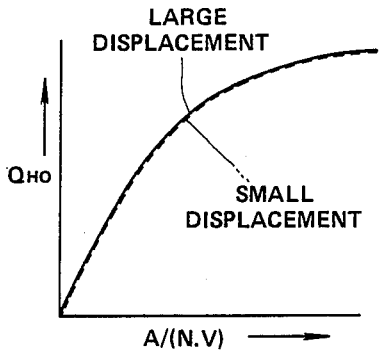
FIGS. 21 to 24 are graphs which depict pre-memorized ROM tables used in conjunction with the fourth embodiment and/or demonstrate an advantage derived with the fourth embodiment.
Figure 22:
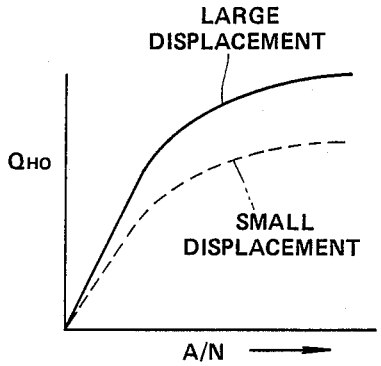

FIG. 20 shows a fourth embodiment of the present invention. This embodiment is basically similar to the one disclosed in connection FIGS. 12 to 14. However, in this instance a value of A/N.V is used in combination with QHO. As will be noted from FIG. 21 by using A/N.V in place of A/N a good correlation between large displacement and small displacement engines is achieved. However, as will be evident from FIG. 22, in the event that A/N only is used, the value of QHO varies considerably with the engine displacement. Accordingly, when A/N is used it is necessary to record a set different data for each displacement.

Figure 23:
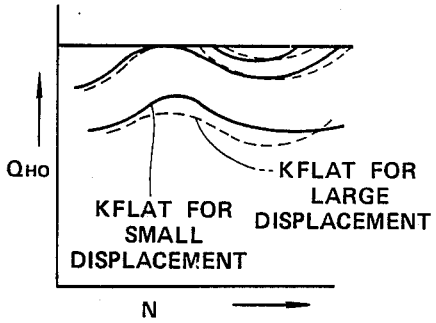
Figure 24:
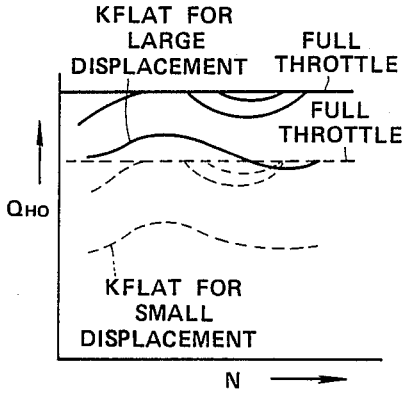

As will be apparent from FIG. 23 when the A/N.V values are used a difference appears between the corresponding values of the correction coefficient KFLAT. However, the differences are rather minor and accordingly correction is comparatively easy. On the other hand, in the case that the A/N value is used, then as shown in FIG. 24 the difference becomes marked and it is necessary to record two sets of data.

Thus, as will be appreciated, this embodiment enables a reduction in the amount of data which must be recorded in ROM via the use of the value A/N.V which can be readily calculated without the need of memory consuming tables or maps.

This permits a reduction in cost in the event that it is desired to use the same memory unit in various different types of engines having different displacements and thus obviates the need to have a different ROM for each engine.

Figure 25:
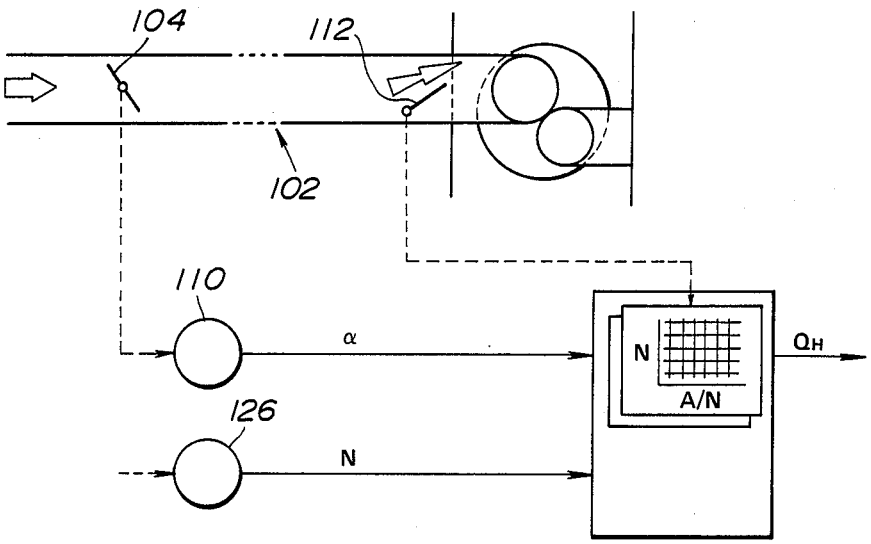
FIG. 25 is a schematic representation showing the arrangement which characterizes a fifth embodiment of the present invention.

FIG. 25 shows in schematic form the characteristic arrangement of a fifth embodiment of the present invention. This embodiment has been designed in view of the fact that when the induction system is provided with a swirl control device it is necessary to take the effect of the same into consideration when calculating the amount of fuel to be injected. Viz., the position of the swirl vane or valve influences the cross-sectional area of the induction passage and thus induces the problem that it tends to render the derivation of the amount of air being inducted into the engine using techniques as disclosed above, erroneous.

In this embodiment it is assumed that the swirl control valve (SCV) is controlled in a manner which switches it from an operative position to an inoperative one and vice versa. Viz., under low load operation the vane or valve member 112 is moved to the position illustrated in FIG. 2 so that the flow of incoming air is throttled and simultaneously forced to flow through the cut out 134. This causes a relatively high velocity jet of air and/or air/fuel mixture (depending on the location of the fuel injector or injectors) to enter the combustion chamber and establish a swirling air pattern therein. Conversely, when the engine is operating under medium to high load the valve is moved to its "inoperative" position. This reduces the throttling of the engine and permits an increase in the charging efficiency.

Although the operation which will described hereinafter is such as to provide control for only two positions of the SCV (thus reducing the amount of data which must be recorded) it is possible to provide control which allows for a multi-position setting. However, this of course requires data to be recorded for each of the positions and thus increases the amount of memory space required.

Figure 26:
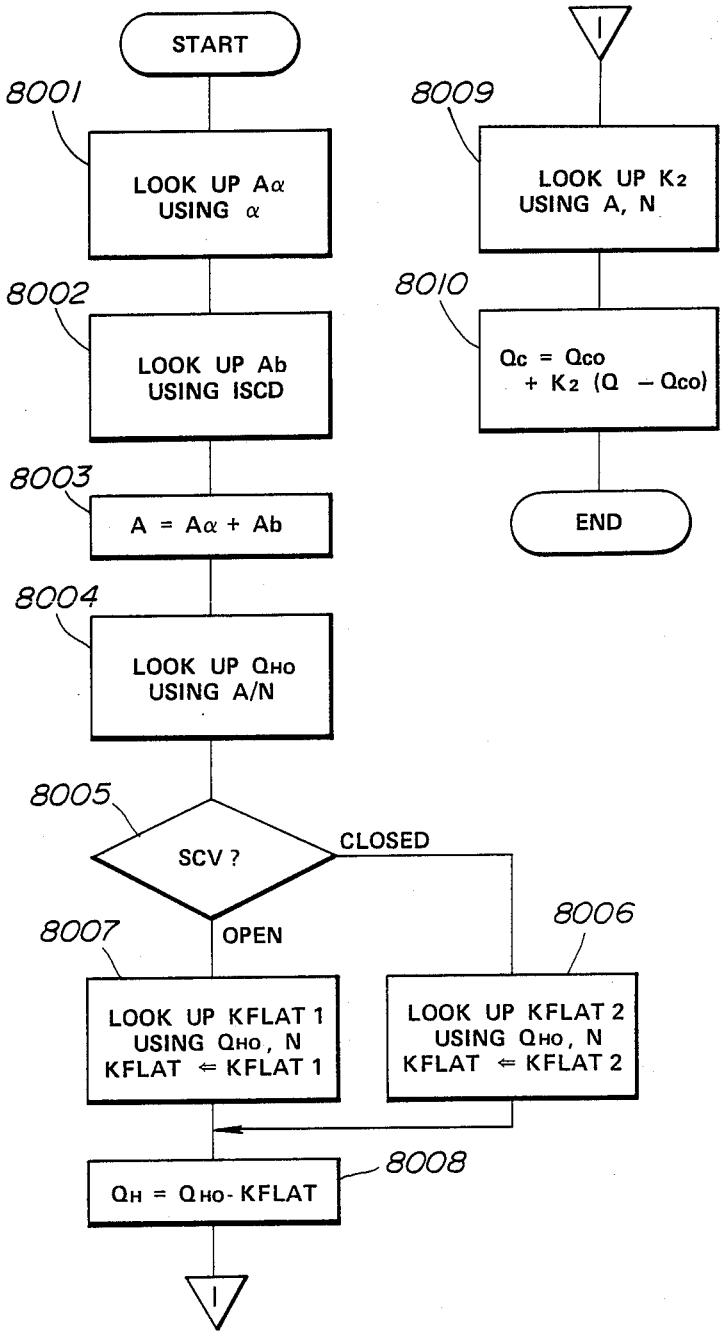
FIGS. 26 and 27 are flow charts showing the steps which characterize the operation of the fifth embodiment.

Steps 8001 to 8004 of the flow chart shown in FIG. 26 are essentially identical to steps 1001 to 1004 of FIG. 4 and make use of tables of the nature illustrated in FIGS. 5 to 8. At step 8005 the current status of the SCV is sampled. If the SCV is closed (viz., is in its operative position) then at step 8006 the values of QHO and N are used in a table look-up to determine a correction factor KFLAT2 which is subsequently stored temporarily in RAM. However, if the valve is open (viz., is in its inoperative position) then in step 8007 a proceedure similar to that conducted in step 8006 is executed. In this case the look-up is conducted using a KFLAT1 table. It will be noted that the KFLAT1 table and the KFLAT2 table are not shown but are essentially similar to that illustrated in FIG. 14.

At step 8008 correction of the value derived in step 8004 is made to allow for the effect of the SCV and the program flows to step 8009 wherein a correction factor K2 is obtained by table look-up. At step 8010 an air induction value which is corrected to take the effect of engine speed into consideration is calculated and the instant run ends.

Figure 27:
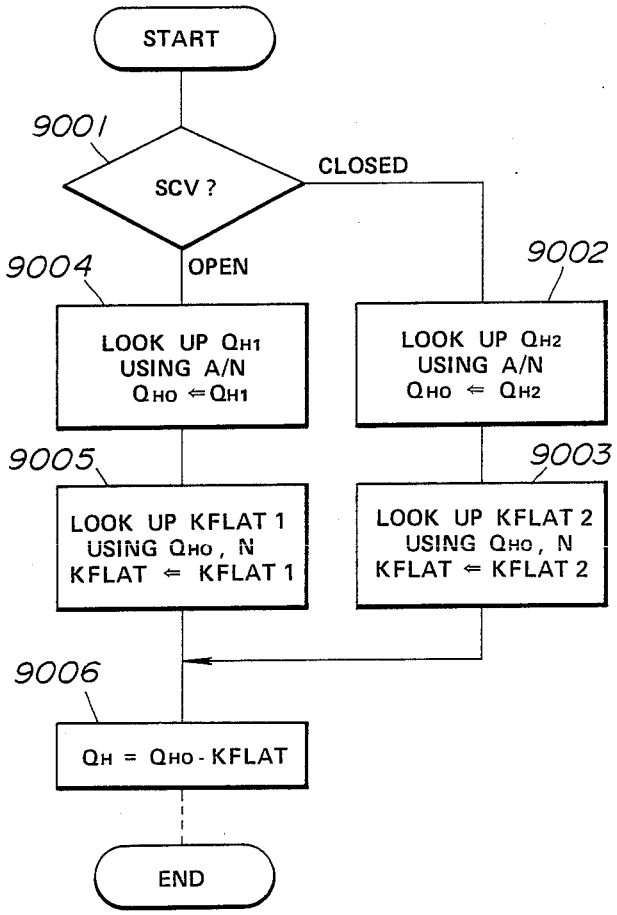

FIG. 27 shows a sixth embodiment of the present invention. This embodiment other than the adaption to take the effect of the swirl generating valve (SCV) into consideration is basically similar in concept to the embodiment disclosed in connection with FIGS. 20 to 24. However, as will be appreciated two sets of tables to enable the look-up of QH1, QH2, KFLAT1 and KFLAT2 are required. Nevertheless, as will be appreciated from the preceeding disclosure, as the tables are recorded in terms of two or three parameters the amount of space required still is minimized as compared with the prior art.

What is claimed is:

1. A method of operating an internal combustion engine comprising the steps of:

sensing a first engine operational parameter which indicates the load on the engine;

sensing a second engine operational parameter which indicates the rotational speed of the engine;

recording a first set of data in a memory means, said first set of data defining a first two dimensional map which is recorded in terms of said first engine operational parameter and a first variable which varies with the degree by which air flow to said engine is restricted;

deriving a value of said first variable by comparing the value of said first engine operational parameter with said first set of recorded data;

modifying said first variable using the value of said second engine operational parameter to derive a second variable;

recording a second set of data in said memory means, said second set of data defining a second two dimensional map, said second set of data being recorded in terms of said second variable, said second engine operational parameter and a third variable which is indicative of an amount of air being inducted into said engine; and comparing the values of said second variable and said first parameter with said second set of recorded data to obtain a value of said third variable.

2. A method as claimed in claim 1 further comprising the steps of:

deriving a first correction coefficient using the values of said first variable and said second engine operational parameter, said deriving of a first correction coefficient including use of said first variable and said second engine operational parameter with a third set of recorded data, said third set of recorded data being stored in said memory means and recorded in terms of said first variable and said second parameter; and correcting said third variable using said first correction coefficient to obtain a fourth variable, said fourth variable accurately indicating said amount of air inducted into said engine.

3. A method as claimed in claim 2 further comprising the steps of:

deriving an engine displacement correction coefficient using a fourth set of recorded data, said fourth set of recorded data being stored in said memory means, said fourth set of recorded data being recorded in terms of said second engine operational parameter and said third variable and indicative of the effect of engine displacement on induction characteristics of said engine;

modifying said third variable using said engine displacement correction coefficient to obtain a modified value of said third coefficient; and correcting said modified value using said first correction coefficient to obtain said fourth variable.

4. A method as claimed in claim 3 wherein said step of modifying said first variable includes use of a product of a value indicative of the displacement of the engine and the engine speed.

5. A method as claimed in claim 1 further comprising the steps of:

sensing a status of a device which modifies operation of said engine in a manner which changes induction characteristics and which influences said amount of air which is inducted into said engine; and selectively correcting the value of said third variable in accordance with said status of said device.

6. A method as claimed in claim 2 further comprising using said fourth variable for determining a fuel supply control to said engine.

7. An internal combustion engine, comprising:

first sensor means for sensing a first engine operational parameter which indicates the load on said engine;

second sensor means for sensing a second engine operational parameter which indicates the rotational speed of said engine;

memory means for storing data;

a first set of data, said first set of data being recorded in said memory means, said first set of data defining a first two dimensional map which is recorded in terms of said first engine operational parameter and a first variable which varies with the degree by which air flow to said engine is restricted;

first derivation means for deriving a value of said first variable by comparing the value of said first engine operational parameter with said first set of data;

first modification means for modifying said first variable using the value of said second engine operational parameter to derive a second variable;

a second set of data, said second set of data being recorded in said memory means, said second set of data defining a second two dimensional map, said second set of data being recorded in terms of said second variable, said second engine operational parameter and a third variable which is indicative of an amount of air being inducted into said engine; and comparison means for comparing the values of said second variable and said first engine operational parameter with said second set of data to obtain a value of said third variable.

8. An internal combustion engine as claimed in claim 7, further comprising:

second derivation means for deriving a first correction coefficient using the values of said first variable and said second engine operational parameter, said deriving of a first correction coefficient including use of said first variable and said second engine operational parameter with a third set of data, said third set of data being stored in said memory means and recorded in terms of said first variable and said second engine operational parameter; and first correction means for correcting said third variable using said first correction coefficient to obtain a fourth variable.

9. An internal combustion engine as claimed in claim 8, further comprising:

third derivation means for deriving an engine displacement correction coefficient using a fourth set of data, said fourth set of data being stored in said memory means, said fourth set of data being recorded in terms of said second engine operational parameter and said third variable and indicative of the effect of engine displacement on induction characteristics of said engine;

second modification means for modifying said third variable using said engine displacement correction coefficient to obtain a modified value of said third coefficient; and second correction means for correcting said modified value using said first correction coefficient to obtain said fourth variable.

10. An internal combustion engine as claimed in claim 9 wherein said first modification means utilizes a factor which is indicative of the displacement of said engine.

11. An internal combustion engine as claimed in claim 7 further comprising:

third sensor means for sensing a status of a device which modifies operation of said engine in a manner which changes induction characteristics and influences an amount of air inducted into said engine; and selection means for selectively correcting the value of said third variable in accordance with said status of said device.

12. An internal combustion engine as claimed in claim 7 further comprising control means for using said fourth variable to control the supply of fuel to said engine.

13. A method of operating an internal combustion engine, comprising the steps of:

sensing a throttle valve position of a throttle valve which is disposed in an induction passage through which air flows to a combustion chamber of said engine;

sensing a rotational speed of said engine;

deriving a first effective cross-sectional area of said induction passage using said throttle valve position and a first set of pre-memorized data which is contained in a memory and which is recorded in terms of said throttle valve position and said first effective cross-sectional area, said first set of pre-memorized data being arranged to define a first two dimensional map;

deriving a basic air induction amount using said first effective cross-sectional area and said rotational speed said step of deriving a basic air induction amount including using a second set of pre-memorized data, said second set of pre-memorized data being stored in said memory, said second set of pre-memorized data being recorded in terms of engine speed and said first effective cross-sectional area, said second set of pre-memorized data being arranged to define a second two dimensional map;

deriving a correction factor using said first effective cross-sectional area, said rotational speed and a third set of pre-memorized data which is contained in said memory and which is recorded in terms of said first effective cross-sectional area, said rotational speed and said correction factor, said third set of pre-memorized data defining a third two dimensional map; and modifying said basic air induction amount using said correction factor to derive an accurate estimate of an amount of air inducted into said engine.

14. A method as claimed in claim 13, further comprising the step of using said accurate estimate to derive an amount of fuel to be supplied to said engine.

15. A method as claimed in claim 14, further comprising the step of using a first type of fuel supply system to deliver fuel, said first type of fuel supply system being constructed and arranged such that fuel is supplied at a location proximate to said combustion chamber.

16. A method as claimed in claim 13, further comprising the steps of:

using a by-pass passage to by-pass said throttle valve when said engine is idling, said by-pass passage including a flow control valve therein;

sensing an opening degree of said flow control valve;

deriving a second effective cross-sectional area of said by-pass passage using a flow control valve position and a third set of pre-memorized data which is recorded in terms of said flow control valve position and said second effective cross-sectional area; and adding said second effective cross-sectional area to said first effective cross-sectional area before deriving said basic air induction amount.

17. A method as claimed in claim 13, further comprising the steps of:

supplying fuel to said engine using a second type of supply arrangement wherein fuel is supplied to said engine at a location which is relatively distant from said combustion chamber;

adding an additive value corresponding to a predetermined amount of air to said accurate estimate, said additive value corresponding to a predetermined amount of air selected to compensate for distance between a location at which fuel is supplied and said combustion chamber.

18. A method as claimed in claim 13, further comprising the steps of:

modifying the flow of air in said induction passage using a swirl control device, said swirl control device being arranged to throttle the flow of air in said induction passage in a manner to increase the velocity with which air enters said combustion chamber;

monitoring operation of said swirl control device;

correcting the value of said accurate estimate in accordance with an operative status of said swirl control device in a manner which compensates for the effect of the throttling provided by said swirl control device on said first effective cross-sectional area of said induction passage.

19. A method as claimed in claim 13, wherein said deriving of said basic air induction amount is conducted with said second set of data being recorded in terms of engine speed and said first effective cross-sectional area divided by the product of an engine speed and a value indicative of engine displacement.

20. A method of operating an internal combustion engine, comprising the steps of:

sensing a throttle valve position of a throttle valve which is disposed in an induction passage through which air flows to a combustion chamber of said engine;

sensing a rotational speed of said engine;

deriving a first effective cross-sectional area of said induction passage using said throttle valve position and a first set of pre-memorized data which is contained in a memory means and which is recorded in terms of said throttle valve position and said first effective cross-sectional area, said first set of pre-memorized data being arranged to define a first two dimensional map;

deriving a basic air induction amount using said first effective cross-sectional area and said rotational speed said deriving of said basic air induction amount including use of a second set of pre-memorized data, said second set of pre-memorized data being stored in said memory means, said second set of pre-memorized data being recorded in terms of said first effective cross-sectional area divided by engine speed and said basic air induction amount, said second set of pre-memorized data being arranged to define a second two dimensional map;

deriving a correction factor using a third set of pre-memorized data, said third set of pre-memorized data being contained in said memory means and recorded in terms of said rotational speed and said basic induction amount, said third set of pre-memorized data defining a third two dimensional map; and modifying said basic air induction amount using said correction factor to derive an accurate estimate of an amount of air inducted into said engine.

21. An internal combustion engine, comprising:

first sensor means for sensing a throttle valve position of a throttle valve which is disposed in an induction passage through which air flows to a combustion chamber of said engine;

second sensor means for sensing a rotational speed of said engine;

first derivation means for deriving a first effective cross-sectional area of said induction passage using said throttle valve position and a first set of pre-memorized data which is contained in a memory and is recorded in terms of said throttle valve position and said first effective cross-sectional area; and second derivation means for using said first effective cross-sectional area and said rotational speed to derive a basic air induction amount.

22. An internal combustion engine, comprising:

first sensor means for sensing a throttle valve position of a throttle valve which is disposed in an induction passage through which air flows to a combustion chamber of said engine;

second sensor means for sensing a rotational speed of said engine;

first derivation means for deriving a first effective cross-sectional area of said induction passage using said throttle valve position and a first set of pre-memorized data which is contained in a memory and is recorded in terms of said throttle valve position and said first effective cross-sectional area;

second derivation means for using said first effective cross-sectional area and said rotational speed to derive a basic air induction amount;

third derivation means for deriving a correction factor using said first effective cross-sectional area, said rotational speed and a second set of pre-memorized data which is contained in said memory and which is recorded in terms of said first effective cross-sectional area, said rotational speed and said correction factor;

modification means for modifying said basic air induction amount using said correction factor to derive an accurate estimate of an amount of air inducted into said engine.

23. An internal combustion engine as claimed in claim 31, further comprising:

fourth derivation means for using said accurate estimate of said amount of air inducted into said engine to derive an amount of fuel to be supplied to said engine.

24. An internal combustion engine as claimed in claim 31, further comprising:

a first type of fuel supply system, said first type of fuel system being constructed and arranged so that fuel is supplied at a location proximate to said combustion chamber.

25. An internal combustion engine as claimed in claim 22, further comprising:

by-pass means, including a by-pass passage, for by-passing said throttle valve when said engine is idling, said by-pass passage including a flow control valve therein;

third sensor means for sensing an opening degree of said flow control valve disposed in said by-pass passage;

fifth derivation means for deriving a second effective cross-sectional area of said by-pass passage using a flow control valve position and a third set of pre-memorized data which is recorded in terms of said flow control valve position and said second effective cross-sectional area; and first addition means for adding said second effective cross-sectional area of said by-pass passage to said first effective cross-sectional area of said induction passage before deriving said basic air induction amount.

26. An internal combustion engine as claimed in claim 22, further comprising:

a second type of fuel supply arrangement, said second type of fuel supply arrangement being constructed and arranged so that fuel is supplied to said engine at a location which is relatively distant from said combustion chamber; and second addition means for adding a value, corresponding to a predetermined amount of air, to said accurate estimate, said value corresponding to a predetermined amount of air selected to compensate for distance between the location at which fuel is supplied and said combustion chamber.

27. An internal combustion engine, comprising:

first sensor means for sensing a throttle valve position of a throttle valve which is disposed in an induction passage through which air flows to a combustion chamber of said engine;

second sensor means for sensing a rotational speed of said engine;

first derivation means for deriving a first effective cross-sectional area of said induction passage using said throttle valve position and a first set of pre-memorized data, said first set of pre-memorized data being contained in a memory means, said first set of pre-memorized data being recorded in terms of said throttle valve position and said first effective cross-sectional area, said first set of pre-memorized data being arranged to define a first two dimensional map;

second derivation means for deriving a basic air induction amount using said first effective cross-sectional area and said rotational speed, said second derivation means including use of a second set of pre-memorized data, said second set of pre-memorized data being stored in said memory means, said second set of pre-memorized data being recorded in terms of said first effective cross-sectional area divided by engine speed and said basic air induction amount, said second set of pre-memorized data being arranged to define a second two dimensional map;

third derivation means for deriving a correction factor using a third set of pre-memorized data, said third set of pre-memorized data being contained in said memory means and recorded in terms of said rotational speed and said basic induction amount, said third set of pre-memorized data defining a third two dimensional map; and modification means for modifying said basic air induction amount using said correction factor to derive an accurate estimate of an amount of air inducted into said engine.

* * * * *